United States Patent [19]

Terwilliger

[11] 4,112,189

[45] Sep. 5, 1978

[54] PROCESS FOR MULTI-COLOR VALLEY PRINTING AND EMBOSSING OF FLOORING MATERIAL AND THE LIKE AND FLOORING MATERIAL MADE BY SAID PROCESS

[75] Inventor: Bruce J. Terwilliger, Newburgh, N.Y.

[73] Assignee: GAF Corporation, New York, N.Y.

[21] Appl. No.: 658,230

[22] Filed: Feb. 17, 1976

Related U.S. Application Data

[62] Division of Ser. No. 513,574, Oct. 10, 1974, abandoned.

[51] Int. Cl.[2] ..... D06C 23/04

[52] U.S. Cl. ..... 428/443; 101/32; 101/211; 427/264; 427/265; 427/278; 427/428; 428/500

[58] Field of Search ..... 101/32, 211; 427/264, 427/265, 278, 428; 428/443, 500

[56] References Cited

U.S. PATENT DOCUMENTS

| | | | |
|---|---|---|---|
| 1,744,410 | 1/1930 | Morton | 427/264 X |
| 1,778,353 | 10/1930 | Campbell | 427/264 X |
| 2,390,618 | 12/1945 | Roehm | 101/32 |
| 2,785,081 | 3/1957 | Babiarz et al. | 101/32 X |
| 2,889,651 | 6/1959 | Baldanza | 101/32 X |
| 3,188,948 | 6/1965 | Fischer et al. | 101/178 |
| 3,399,101 | 8/1968 | Magid | 101/32 X |
| 3,434,861 | 3/1969 | Luo | 427/264 X |
| 3,573,136 | 3/1971 | Gardner | 101/32 X |
| 3,850,095 | 11/1974 | Snyder | 101/32 |
| 3,887,678 | 6/1975 | Lewicki | 101/32 X |

*Primary Examiner*—Michael R. Lusignan

*Attorney, Agent, or Firm*—Walter C. Kehm; J. G. Mohr

[57] ABSTRACT

A process for multi-color valley printing and embossing of thermoplastic sheets and the like is provided wherein the number of colors that may be printed on such sheets simultaneously with the embossing operation exceeds the number of different color inks utilized by printing such inks individually in certain area and by blending two or more of the different color inks to print additional colors in other areas. A plurality of such different color inks are applied to the surface of a rotatable embossing and printing roll in a manner such that certain discrete surface areas thereof receive individual layers of a single color ink and other discrete surface areas thereof receive overlapping layers of at least two different color inks. During the embossing operation, the roll is rotated in contact with a sheet of thermoplastic material to emboss a design and print single colors on such sheet in the areas thereof contacted by the surface of the roll containing the individual layers of single color ink, and to emboss and print additional colors derived from blending the overlapping layers of the different color inks under the pressure of the embossing and printing roll in the areas of the sheet contacted by the surface of the roll containing such overlapping layers of different color inks.

12 Claims, 9 Drawing Figures

FIG.1
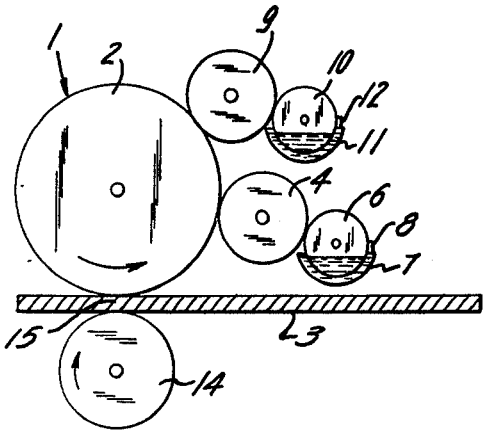
FIG.2
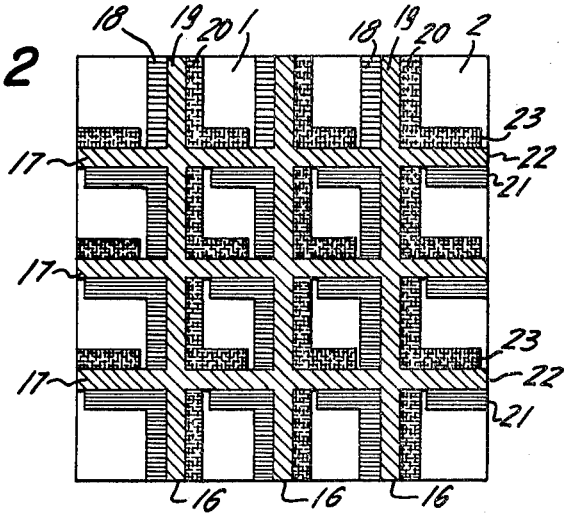
FIG.3
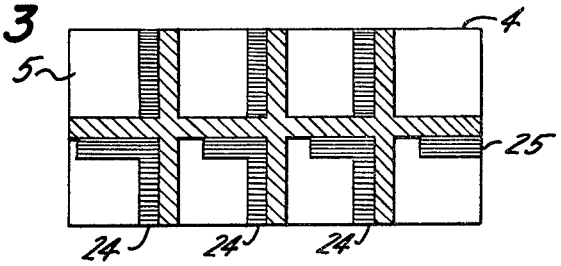
FIG.4
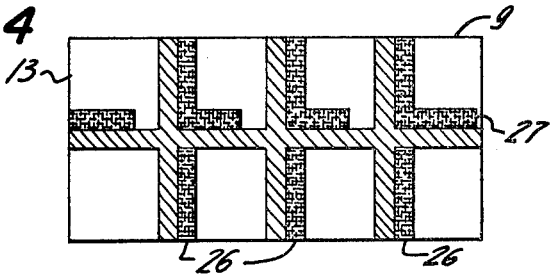
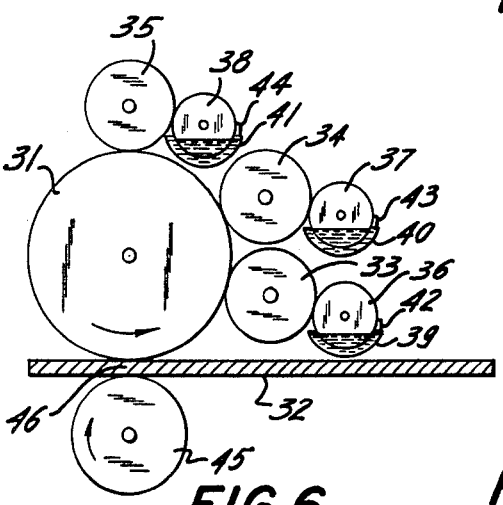
FIG.6
FIG.5
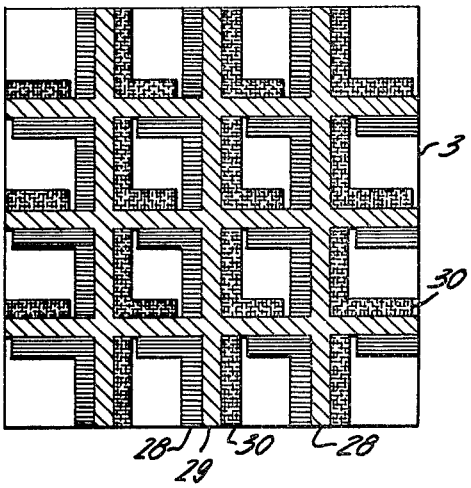

PROCESS FOR MULTI-COLOR VALLEY PRINTING AND EMBOSSING OF FLOORING MATERIAL AND THE LIKE AND FLOORING MATERIAL MADE BY SAID PROCESS

This is a division of application Ser. No. 513,574, filed Oct. 10, 1974, now abandoned.

BACKGROUND OF THE INVENTION

Valley printing and embossing techniques used in the manufacture of flooring material formed of thermoplastic sheets and the like are quite well known. However, in the past, such techniques required the use of separate and distinct inks for each and every color of a multicolor pattern or design to be transferred from an embossing and printing roll to the sheet material. Each of such inks required its own container and reservoir. In addition, individual rubber pattern rolls, capable of transferring ink to the desired areas of the embossing and printing roll, and individual annolox rolls to pick up ink from the reservoirs and apply such ink to the pattern rolls were also required for each color ink. Moreover, it was considered essential to keep the different color inks separated on the embossing and printing roll to avoid contaminating the ink reservoirs with other colors used in the design by the reverse pick-up of one color ink by a pattern roll for another color ink. Accordingly, the colors printed on the embossed sheets were separated in the design by at least an eighth of an inch, since the cost of engraving the various rolls to provide for a closer disposition of the different colors was prohibitive. Because of this deficiency, the designs and decorative patterns that could be utilized in the manufacture of flooring material were often limited, and in those cases where the designs sought to simulate bricks, ceramic tiles and other designs requiring various shades and colors, the resultant flooring material often lacked realism. Similarly, the size and cost of the prior embossing and printing equipment increased significantly with the addition of each color, due to the difficulty in maintaining proper inks separation and the necessity to provide for the transfer and feeding of each ink from its respective source to the embossing and printing roll. As a result, equipment to emboss and print more than two or three colors became so complex and costly so as to render such equipment quite impractical for manufacturing flooring material on a mass production basis.

To overcome these deficiencies in the valley printing and embossing techniques heretofore employed, attempts have been made to print additional colors by first printing one or two colors on a sheet of flooring material by conventional valley printing techniques and then superimposing over the previously printed material additional color inks applied by means of further valley printing rolls. However, such techniques have also proved to be quite impractical since it is quite difficult to keep two or more embossing and printing rolls in perfect registration with one another and the sheet material during the sequential printing process. Moreover, to accomplish this technique, a special transparent ink to be superimposed over the prior printed portions is required. The transparency of the top ink permits the prior printed underlayer of ink to show through and thereby form the illusion of a further color. Accordingly, the additional colors printed in this manner often have a poor appearance.

SUMMARY OF THE INVENTION

In accordance with the present invention, an apparatus and process for multi-color valley printing and embossing of flooring material and the like is provided which overcomes all of the deficiencies found in the prior art, and in particular permits the printing of additional colors derived from blending two or more basic inks applied to a single embossing and printing roll. In this manner, the need for separating the different colors, as well as the need for additional printing rolls to superimpose additional color inks over a previously printed pattern are eliminated along with the associated problem of maintaining proper synchronization and alignment between the engraved designs on two or more printing rolls and the design printed on the sheet. In addition, the blending of different color inks to produce additional colors yields higher quality results than merely superimposing a transparent ink over a previously printed opaque ink of another color to produce a third color. Using the apparatus and process of the present invention it is possible with the utilization of two basic color inks to produce a valley printed and embossed flooring material having three colors, wherein the two basic colors are individually printed in certain portions of the design, and are blended to produce the third color in other portions of the design. Similarly, it is also possible using the technique of the present invention to valley print seven colors with the use of merely three basic color inks. This is accomplished by printing the three inks individually in certain areas of the design by blending pairs of the three colors to print three additional colors in other areas of the design, and by blending all three colors to print a seventh color in still further portions of the design. It addition, the various color inks can be blended in differing proportions to valley print varying hues and shades of the blended colors to produce flooring material having aesthetic designs heretofore unattainable in mass produced products of this type.

In general, the appratus of the invention comprises, in combination, a rotatable embossing and printing roll having an engraved surface contour representing a decorative pattern or design to be embossed and printed on a sheet of material; a plurality of rotatable pattern rolls in operative engagement with the surface of the embossing and printing roll, each adapted to receive a different color ink and to transfer such ink to a discrete surface area of the embossing and printing roll in a manner such that certain portions of the surface area thereof receive one color ink from a single pattern roll and other portions thereof receive overlapping layers of different color inks from at least two pattern rolls; and means for advancing a sheet of material to be embossed into contact with, and under pressure of, the rotatable embossing and printing roll to emboss said sheet with the pattern on said roll, to print individual colors in the area of the sheet contacted by the surface of the embossing and printing roll containing one color ink, and to print additional colors derived from blending the overlapping layers of different color inks under pressure of the embossing and printing roll in the areas of the sheet contacted by the surface of the embossing and printing roll containing the overlapping layers of such different color inks.

The process of the invention comprises, in general, the steps of applying a plurality of different color inks, respectively, to a corresponding plurality of rotatable pattern rolls; transferring said different color inks from the pattern rolls to discrete surface areas of a rotatable embossing and printing roll having an engraved decorative pattern defining the surface contour thereof in a manner such that certain portions of the surface area of said embossing and printing roll receive one color ink from single pattern rolls and other portions of the surface area receive overlapping layers of different color inks from at least two pattern rolls; advancing a sheet of thermoplastic flooring material or the like into contact with, and under pressure of, the embossing and printing roll; embossing said sheet with the engraved pattern on said embossing and printing roll; and simultaneously printing individual colors in the areas of the sheet contacted by the surface of the embossing and printing roll containing one color ink, and printing additional colors derived from blending the overlapping layers of different color inks under the pressure of the embossing and printing roll in the areas of the sheet contacted by the surface of the embossing and printing roll containing the overlapping layers of such different color inks.

It should be noted at this juncture that the apparatus of the present invention is quite similar in construction to prior valley printing and embossing devices; the primary difference being in the surface configuration of the pattern rolls utilized to apply the different color inks to the embossing and printing roll to achieve individual colors and blended colors as noted hereinabove. Accordingly, with a minimum amount of reworking expense prior valley printing and embossing devices can be converted to conform with the present invention and thereby permit the process of the present invention to be implemented at a correspondingly low expense and a minimum of equipment down time.

As noted above, the embossing and printing roll has an engraved surface contour, wherein the raised portions thereof correspond to the decorative pattern or design to be embossed and printed on the flooring material or other sheet material utilized with the apparatus. This roll is preferably formed of chrome-plated steel material or any other hardened metallic substance capable of deforming vinyl asbestos or other sheet material transported into pressurized contact therewith to emboss the pattern from the roll onto such sheet material. The raised portions of the engraved pattern on the roll simultaneously emboss and print the sheet, and accordingly, such raised areas preferably have a screened surface well known in the art for receiving and retaining ink applied thereto by the pattern rolls prior to the application of such ink to the sheet material.

The pattern rolls have a hard rubber surface, such as neoprene or the like, formed with raised portions corresponding to predetermined discrete raised surface areas of the embossing and printing roll to which ink from such pattern roll is to be applied. It will be understood by those skilled in the art that the raised areas of the pattern rolls need not be identical in shape to the corresponding raised areas of the embossing and printing roll. All that is required is that the raised areas of such pattern rolls be sufficiently large so as to cover with ink those areas of the embossing and printing roll to which such ink must be applied, without applying ink to adjacent areas. Therefore, raised areas of the pattern rolls can be either larger or smaller than the corresponding raised areas on the embossing roll depending on the color pattern desired.

Each of the pattern rolls receive ink from an individual annalox or pick-up roll which is disposed partially within a corresponding reservoir containing the desired color ink. The reservoirs are essentially in the form of open trays to permit the rotatable movement therein of an annalox roll, which thereupon picks up ink from the tray and transfers the same to the pattern roll. The annalox roll is preferably formed of chrome-plated steel material and has formed in the surface thereof a series of cells preferably in the form of indentated squares, commonly known as quads, to retain the ink picked up from the reservoir. The size and number of the quads determine the amount of ink that the annolox rolls can retain and transfer to the pattern rolls. Accordingly, by varying the quad pattern the overlapping layers of ink on the embossing roll can be blended in any desired proportions to obtain particular color hues and shades. In addition, a doctor blade formed along one edge of each reservoir engages the annalox roll disposed therein to also control the amount of ink applied thereto.

Each pattern roll, its corresponding annalox roll and the reservoir from which the annalox roll receives ink, defining an ink transfer system, are positioned in a horizontal plane above the moving sheet of flooring material, and each such ink transfer system is vertically spaced with respect to the adjacent ink transfer system, so that each of the pattern rolls are in operative contact with the embossing and printing roll.

It will be apparent to those skilled in the art that it is necessary to synchronize the pattern rolls with respect to each other and with respect to the surface area of the embossing and printing roll to insure that the proper color ink is transferred to the desired location on the embossing and printing roll. To accomplish this, the embossing and printing roll and the pattern roll and annalox roll of each ink transfer system are all operatively linked together by a suitable gear train, which is rotatably driven by a suitable electric motor. Each of the rolls is, of course, properly positioned prior to their respective connection to the gear train. However, to provide for additional adjustment each roll can be connected to the gear train by a clutch, which permits its disengagement for synchronization purposes.

In addition to the foregoing described rolls, a backing roll positioned beneath the embossing roll is also provided. Such backing roll, together with the embossing and printing roll defines a nip through which the sheets of flooring material are advanced during the embossing and printing operation. The backing roll is also connected to the gear train to insure synchronized rotation of such roll with the embossing and printing roll, and is formed of hardened steel material having a relatively smooth surface so as not to deform the underside of the sheet material passed through the nip. The height of the nip is, of course, controlled by the distance between the embossing and printing roll and the backing roll, and such distance can be adjusted to insure that the embossing and printing roll exerts the required amount of pressure upon the sheet material passed therethrough for proper embossing and blending of the various layers of ink.

It should be noted that since the additional colors are derived from blending two or more layers of different color inks in any desired proportion, any relatively light viscosity valley printing ink known in the art, such as vinyl and plastized inks, can be utilized with the apparatus and process of the present invention.

It should also be noted that although the invention is described herein as be adapted for the production of flooring material, it can also be utilized for embossing and valley printing and thermoplastic or other embossable sheet material having other end uses, such as wall and ceiling tiles and panels. It is primarily intended that continuous sheets of the desired material be advanced through the apparatus of the invention, and that after such sheets are embossed and printed they be cut into tiles or panels having the desired size and shape. However, as an additional feature of the invention the embossing and printing roll can be formed with knife-like projections to cut such sheets simultaneously with the embossing and printing operation.

The apparatus and process of the invention are further described with reference to the annexed drawings.

BRIEF DESCRIPTION OF THE DRAWINGS

FIG. 1 is a schematic diagram of one embodiment of the apparatus of the invention;

FIG. 2 is a plan view of the engraved surface of the embossing and printing roll shown in FIG. 1;

FIG. 3 is a plan view of the surface of one pattern roll shown in FIG. 1;

FIG. 4 is a plan view of the surface of the other pattern roll shown in FIG. 1;

FIG. 5 is a plan view of a floor tile valley printed and embossed with the apparatus shown in FIG. 1; and FIG. 6 is a schematic diagram of another embodiment of the apparatus of the invention.

DETAILED DESCRIPTION OF PREFERRED EMBODIMENTS

Figure 7:
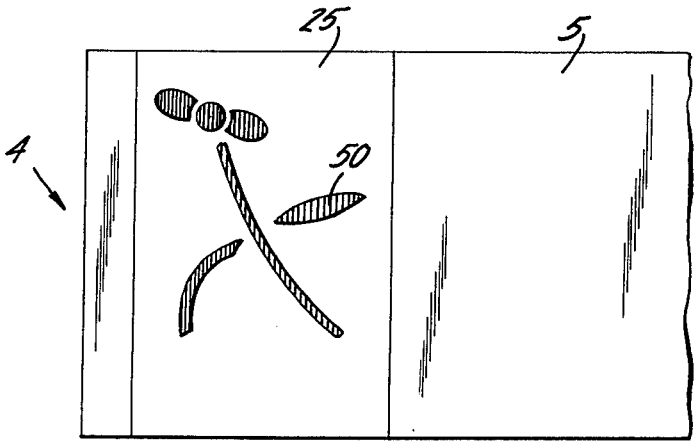
FIG. 7 is an enlarged partial plan view of the surface of one pattern roll.

FIG. 1 illustrates one embodiment of the apparatus of the invention adapted for valley printing and embossing a sheet of vinyl asbestos flooring material with a design having three distinct colors, which colors are derived from two different color inks. As shown in FIG. 1, the apparatus comprises a rotatable embossing and printing roll 1 having a surface contour 2 (illustrated in FIG. 2) representing the pattern to be embossed and printed upon a sheet of flooring material 3, and a rotatable pattern roll 4 for receiving a first color ink disposed in operative engagement with embossing and printing roll 1 and adapted to transfer such first color ink to particular discrete surface areas of the embossing and printing roll. The surface contour 5 of pattern roll 4 is illustrated in FIG. 3 and will be described in detail hereinafter. An annalox roll 6 rotatably disposed within an ink reservoir 7 receives ink from such reservoir and transfers the same to the surface of pattern roll 4. A doctor blade 8 formed along one edge of reservoir 7 serves to meter the amount of ink applied to the surface of annalox roll 6. In addition, the surface of roll 6 is formed with a plurality of square indentations or quads which control the amount of ink that may be retained on the surface of the annalox roll and transfered to pattern roll 4.

A second rotatable pattern roll 9 for receiving a second color ink is also disposed in operative engagement with embossing and printing roll 1 for transferring the second color ink to other particular discrete surface areas of the embossing and printing roll not containing the first color ink and to portions of the surface thereof containing such first color ink to overlap the same. The second pattern roll 9 receives ink from a corresponding annalox roll 10, which is rotatably disposed within a reservoir roll 11 containing the second color ink. Annalox roll 10 also has formed in the surface thereof a plurality of quads to control the amount of second color ink retained thereby and transferred to pattern roll 9. A doctor blade 12 formed along an edge of reservoir 11 properly meters the ink onto the surface annalox roll 10. The surface contour 13 of pattern roll 9 is illustrated in FIG. 4 and will be described in detail hereinafter.

A rotatable backing roll 14 is disposed adjacent the embossing and printing roll 1 and defines therebetween a nip 15 through which sheet 3 to be embossed and printed is passed. A gear train (not shown) operatively connects rolls 1, 4, 6, 9, 10 and 14 to insure proper synchronization therebetween. Such gear train is operatively driven to rotate all of said rolls by means of an electric motor, also not shown. The sheet material 3 is advanced through the nip 15 by the combined rotational movement of the embossing and printing roll 1 and the backing roll 14. Any suitable conveyor can be utilized for feeding such sheet material 3 into the nip 15 during the embossing and printing operations.

The engraved surface 2 of the embossing and printing roll 1 is shown in FIG. 2. It should be emphasized that the design pattern shown in FIG. 2 is provided for illustrative purposes only and is in no way intended to limit the scope of the present invention to such design. It will be apparent to those skilled in the art that other designs, patterns and configurations for the embossing and printing roll can be provided. It should also be noted that FIG. 2 shows the surface 2 of embossing and printing roll 1 removed from the roll and disposed in a single plane for the purpose of illustrating the entire configuration thereof.

As noted hereinabove roll 1 has a chrome-plated steel surface capable of embossing and simultaneously printing sheet 3 as such sheet is moved into contact with particular sections of the engraved surface of roll 1. The surface 2 comprises a plurality of parallel, vertically disposed, spaced apart, raised sections 16, and a plurality of parallel horizontally disposed spaced apart raised sections 17, which, together with the vertical sections 16 define a grid-like pattern adapted to emboss and print a plaid design upon sheet material 3. The embossing and printed sheet is shown in FIG. 5 and will be described in detail hereinafter. The squares of the grid defined by the raised portions 16 and 17 represent indented portions of the surface 2, which do not contact the sheet material 3. Accordingly, the design embossed upon sheet 3 corresponds in every detail to the raised portions 16 and 17, and the ink applied to raised portions 16 and 17 by means of pattern rolls 4 and 9 will be printed upon sheet 3 simultaneously with the embossing thereof. It can be seen that each of the vertically disposed raised sections 16 contains three distinct parallel segments 18, 19 and 20. Similarly, the horizontally disposed raised portions 17, also include three distinct sections 21, 22 and 23. The surface of all of the raised portions 16 and 17 of the design engraved on the embossing and printing roll have a screened surface well known in the art for receiving and retaining the ink applied thereto from pattern roll 4 and 9 and form printing such ink on sheet 3.

The surface 5 of pattern roll 4 is formed of a hard rubber substance having vertically disposed parallel spaced apart raised sections 24, and a pair of horizontally disposed parallel spaced apart raised sections 25. The pattern roll 4 is positioned with respect to embossing and printing roll 1 such that raised sections 24 are adapted to be aligned with segments 18 and 19 of the raised sections 16 of embossing and printing roll 1, and that the horizontal raised sections 25 of the pattern roll 4 are adapted to engage segments 21 and 22 of the horizontal raised sections 17 of the embossing and printing roll 1 during the rotation of such rolls. Annalox roll 6 applies the first color ink to the raised portions 24 and 25 of pattern roll 4, whereupon such ink is transferred from the pattern roll to segments 18, 19, 21 and 22 of the raised sections 16 and 17 of embossing and printing roll 1. It will be apparent to those skilled in the art that the first color ink is applied to the embossing and printing roll only in those areas of the embossing and printing roll contacted by the raised portions 24 and 25 of the pattern roll 4.

The surface 13 of pattern roll 9 is also formed of hard rubber material and includes vertically disposed parallel spaced apart raised portions 26, and a pair of horizontally disposed parallel spaced apart raised sections 27. Pattern roll 9 is positioned in a manner such that raised portions 26 thereof contact segments 19 and 20 of the raised sections 16 in the embossing and printing roll, and that horizontal raised sections 27 contact segments 22 and 23 of the horizontal raised sections 17 of the embossing and printing roll. It can be seen, therefore, that the second color ink which is applied to the raised portions 26 and 27 of the pattern roll 9 by annalox roll 10 is thereupon transferred to segments 19, 20, 22 and 23 of the embossing and printing roll 1. In addition, it can also be seen that segments 18 and 21 of the embossing and printing roll 1 receive only the first color ink, that segments 20 and 23 of the embossing and printing roll receive only the second color ink, and that sections 19 and 22 of the embossing and printing roll 1 receive overlapping layers of the first and second color inks, due to the fact that sections 19 and 22 are both contacted by pattern rolls 4 and 9.

As sheet 3 passes through nip 15 it is embossed and simultaneously printed with the first color ink in the areas thereof contacted by segments 18 and 21 of roll 1, with the second color ink in the areas thereof by segments 20 and 23 of roll 1, and with a third color derived by blending the overlapping layers of the first and second color inks under the pressure of the embossing and printing roll in nip 15 in the areas of sheet 3 contacted by raised sections 19 and 22 of roll 1. The resultant embossed and valley printed sheet is shown in FIG. 5. The plaid pattern on sheet 3 includes the first color printed in the shaded areas designated 28, the second color printed in the non-shaded areas 30, and the third color derived from blending the first and second colors in the solid sections, designated 29. In the illustrated plaid pattern it can be seen that in certain portions the printed sections 28 and 30 containing the first and second colors, respectively, do not abutt one another. This is purely a matter of design choice, since the apparatus of the invention permits the abuttment of such adjacent colors, as shown in areas 29 where the third color intersects both the first and second colors.

It should be noted that the overlapping layers of the first and second color inks need not contain equal quantities of such inks, but can be proportioned in any desired manner. Accordingly, the third color can be produced in any hue or shade. As stated hereinbefore, this is accomplished by varying the number and size of the quads in annalox rolls 6 and 10 to receive and apply a pre-determined quantity of ink to respective portions of pattern rolls 4 and 9. For example, if the first color is blue and the second color is yellow, the third color derived from blending blue and yellow ink will be green. However, the particular shade of green can be controlled by varying the amounts of blue and yellow ink applied to the segments 19 and 22 of the raised portions on the embossing and printing roll 1. The various other basic color inks that can be blended to produce a third color will be apparent to those skilled in the art.

The embodiment of the apparatus of the invention illustrated in FIG. 6 is adapted to print up to seven distinct colors by utilizing merely three different color inks. This embodiment comprises a rotatable embossing and printing roll 31 having an engraved surface contour representing the design to be embossed and printed on a sheet of flooring material 32, wherein raised portions of the surface of embossing roll 31 includes specific segments adapted to receive three individual inks to print three separate colors on sheet 32, other segments adapted to receive overlapping pairs of the three color inks to print three additional blended colors on sheet 32, and one or more further segments adapted to receive overlapping layers of the three different color inks to print a seventh color on sheet 32.

A rotatable pattern roll 33 is disposed in operative engagement with roll 31 and is adapted to apply to specific surface areas of roll 31 a first color ink. Similarly, a second pattern rol 34 is adapted to apply a second color ink to other specific areas of roll 31 not containing ink from pattern roll 33, and to a portion of the same areas previously coated with the ink from pattern roll 33. Likewise, a third pattern roll 35 in operative engagement with embossing and printing roll 31 is adapted to apply a third color ink to other specific surface areas of roll 31 not containing ink from pattern rolls 33 and 34, to portions of roll 31 previously coated with individual layers of ink from pattern rolls 33 and 34, and to portions of roll 31 previously coated with overlapping layers of ink from both rolls 33 and 34. Each of the three pattern rolls, 33, 34 and 35 are in operative engagement with corresponding annalox rolls 36, 37 and 38, respectively, which rolls have a plurality of ink retaining quads formed in the surface thereof. Such annalox rolls are each disposed in individual reservoirs, 39, 40 and 41, respectively, from which such annalox rolls pick up the three individual inks and apply the same to pattern rolls 33, 34 and 35. As in the prior embodiment illustrated in FIG. 1, this embodiment also includes doctor blades 42, 43 and 44 formed along one edge of reservoirs 39, 40 and 41, respectively, to properly meter the ink applied to the surface of each of the annalox rolls.

A backing roll 45 is disposed beneath embossing and printing roll 31 and defines together therewith a nip 46 through which the sheet material 32 is advanced during the embossing and printing operation. The height of nip 46 is representing the distance between embossing and printing roll 31 and backing roll 45 is adjustable to control the amount of pressure that roll 31 applies to sheet 32 during the embossing and printing operation to insure proper embossing and blending of the inks. A gear train (not shown) operatively connects embossing and printing roll 31, backing roll 45, pattern rolls 33, 34 and 35, and annalox rolls 36, 37 and 38 so as to maintain complete synchronization between the rotational movement of each of such rolls. An electric motor (not shown) operatively drives the gear train to impart rotational movement to the rolls.

In operation, the surface of pattern roll 33 receives a first color ink from annalox roll 36 and thereupon applies such first color ink to discrete raised surface areas of embossing and printing roll 31. Similarly, the surface of pattern roll 34 receives a second color ink from annalox roll 37 and applies such second color ink to other raised portions of embossing rolls 31 not containing the first color ink and as overlapping layers to a portion of the same raised areas previously coated with such first color ink. In the same manner, the surface of pattern roll 35 is coated with a third color ink by means of annalox roll 38, and thereupon applies such third color ink to raised surface areas of embossing roll 31 not containing the first and second color inks, to other raised areas of roll 31 previously coated with individual layers of the first and second color inks, and to still other raised portions of the surface of roll 31 previously coated with overlapping layers of the first and second color ink. As the embossing and printing roll contacts the sheet material 32 passed through the nip 46, it is embossed by the raised surface portion of roll 31, and simultaneously printed with the one or more layers of ink on roll 31 as the surface portions of such roll contacts sheet 32. In this manner, the design which is valley printed on sheet 32 includes three specific colors in the areas thereof contacted by the raised portions of roll 31 containing individual layers of the first, second and third color inks, three additional colors derived from blending overlapping pairs of the three specific color inks in the area of the sheet contacted by the raised surface portion of roll 31 containing the overlapping layers of the different color inks, and a seventh color in the area of the sheet contacted by the raised portion of roll 31 containing the three overlapping layers of the first, second and third color inks, derived from blending such inks under the pressure of the embossing and printing roll. Various shades and hues of the blended colors can be achieved, as noted hereinabove, by varying the size and quantity of the quads included in each of the three annalox rolls 36, 37 and 38, to obtain a design having any desired tonal effect.

It is of course, unlikely that any design to be valley printed on flooring material or the like would contain more than the seven distinct colors. However, it should be noted that additional colors can be derived by the addition of one or more pattern rolls and corresponding annalox rolls. Accordingly, it will be apparent to those skilled in the art that the apparatus and process of the present invention is not limited to the valley printing of merely seven colors.

As another feature of this invention various multicolor designs can be simultaneously printed within the perimeter of one or more embossed and valley printed areas of the sheet without the necessity of having such designs engraved on the surface of the embossing and printing roll. This is accomplished by providing a raised design on the surface of at least two pattern rolls in the areas thereof corresponding to the areas of the sheet to be embossed. When the ink on each pattern roll is transferred to the embossing and printing roll, and design on such rolls is printed on the surface of the embossing and printing roll in a raised area corresponding to an embossed valley on the sheet. Accordingly, as the sheet is embossed, the printed design on the embossing and printing roll is transferred to the sheet, and the inks which comprise the design to the extent that they overlap are blended to produce a multicolor printed pattern.

Figure 8:
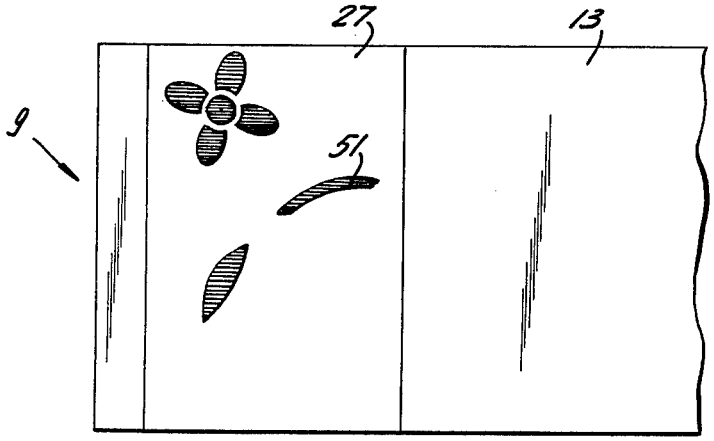
FIG. 8 is an enlarged partial plan view of the surface of another pattern roll.
Figure 9:
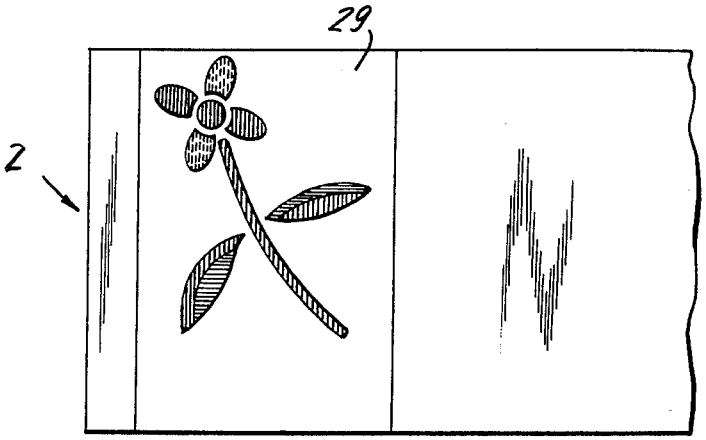
FIG. 9 is an enlarged partial plan view of a design printed on a floor tile.

The foregoing feature is further described with reference to FIGS. 7 to 9, which illustrate the printing of a floral design within an embossed area of the floor tile 3 shown in FIG. 5. A raised partial floral design 50 is provided within one portion of raised section 25 of the surface 5 of pattern roll 4, and is adapted to receive a first color ink. A complimentary raised partial floral design 51 is similarly provided within one portion of raised section 27 of the surface 13 of pattern roll 9 and is adapted to receive a second color ink. The raised floral designs 50 and 51 are positioned on their respective pattern rolls such that they apply the first and second color inks to the raised surface 22 (FIG. 2) of the embossing and printing roll 2 to print a complete floral design having the first and second color inks and one or more areas of overlapping layers of the first and second color inks. As raised surface 22 of the embossing and printing roll 2 comes in contact with sheet 3 during the embossing and printing operation, the floral design is transferred from roll 2 to one position of embossed area 29 as shown in FIG. 9, whereby it is printed as a complete three color floral design comprising the first color, the second color and a third color derived by blending the overlapping layers of the first and second color inks under the pressure of roll 2.

In this manner, different embossed areas of the tile can be printed with various designs without the expense of providing an embossing and printing roll having such designs engraved therein. Moreover, the addition of a third pattern roll as in the embodiment of FIG. 6 greatly increases the design possibilities for this technique, since different portions of the various designs could be printed in different colors.

Additional embodiments of the valley printing and embossing apparatus and method falling within the scope of the present invention will be apparent to those skilled in the art.

What is claimed is:

1. A multicolor valley printed and embossed flooring material made according to the process comprising the steps of:

applying a first color ink to the surface of a first rotatable pattern roll;

transferring said first color ink from the first pattern roll to discrete surface areas of a single rotatable embossing and printing roll having a raised surface contour representing a pattern to be embossed and valley printed;

applying a second color ink to the surface of a second rotatable pattern roll;

transferring said second color ink from the second pattern roll to discrete surface areas of the embossing and printing roll not containing the first color ink and as well as other discrete surface areas thereof containing the first color ink;

advancing a single sheet of flooring material once through a nip defined by the embossing and printing roll and a rotatable backing roll; and embossing the flooring material in the nip under the pressure of the embossing and printing roll, and simultaneously valley printing said flooring material with a first color in the areas thereof contacted by the surface of the embossing and printing roll containing the first color ink, with a second color in the areas thereof contacted by the surface of the embossing, and printing roll containing the second color ink, and with a third color derived from blending the first and second color inks under the pressure of the embossing and printing roll in the areas of the flooring material contacted by the surface of the embossing and printing roll containing the overlapping layers of first and second color inks.

2. A multicolor valley printed and embossed flooring material and the like made according to a process comprising the steps of:

applying a plurality of different color inks, respectively to a corresponding plurality of rotatable pattern rolls;

transferring said different color inks from the pattern rolls to discrete surface areas of a single rotatable embossing and printing roll having a raised surface contour representing a pattern to be embossed and valley printed in a manner such that certain raised areas thereof receive a layer of ink from individual pattern rolls and other raised areas receive overlapping layers of different color inks from at least two different pattern rolls;

advancing a single sheet of flooring material once into contact with and under pressure of the embossing and printing roll; and embossing said sheet with the pattern on said embossing and printing roll, and simultaneously printing individual colors in the areas of the sheet contacted by the surface of the embossing and printing roll containing one layer of ink and printing additional blended colors derived from mixing overlapping layers of different color inks under the pressure of the embossing and printing roll in the areas of the sheet contacted by the surface of the embossing and printing roll containing the overlapping layers of different color inks.

3. A multicolor valley printed and embossed sheet material and the like made according to a process comprising the steps of:

applying a layer of color ink to discrete surface areas of a single rotatable embossing and printing roll having a raised surface contour representing a pattern to be embossed and printed;

applying a layer of second color ink to other discrete surface areas of the embossing and printing roll and as an overlapping layer to predetermined portions of the surface area containing the layer of first color ink;

rotating said embossing and printing roll once in pressurized contact with a single length of sheet material;

embossing said sheet with the pattern on said embossing and printing roll;

printing the first color ink and the second color ink on the sheet in the areas thereof contacted by the surface of the embossing and printing roll containing individual layers of such color inks; and printing an additional blended color derived from mixing the first and second color inks under the pressure of the embosssing and printing roll in the areas of the sheet contacted by the surface of said roll containing said overlapping layers of first and second color ink.

4. A multicolor valley printed and embossed sheet material and the like made according to a process comprising the steps of:

applying a plurality of different color inks to the surface of a single rotatable embossing and printing roll in a manner such that certain discrete surface areas thereof receive a layer of single color ink and other discrete surface areas thereof receive overlapping layers of at least two different color inks;

embossing a single length of sheet material by rotating the embossing and printing roll once in contact therewith;

printing a single color on the sheet in the areas thereof contacted by the surface of the embossing and printing roll containing a layer of single color ink during the embossing operation and;

printing an additional blended color derived from blending overlapping layers of different color inks under the force of the embossing and printing roll in the areas of the sheet contacted by the surface of said roll containing the overlapping layers of different color inks during the embossing operation.

5. A multicolor valley printed and embossed sheet material made in accordance with a process comprising the steps of:

applying a layer of first color ink to discrete surface areas of a single rotatable embossing and printing roll having a raised surface contour representing a pattern to be embossed and printed;

applying a layer of second color ink to other discrete areas of said roll not containing the first color ink and as well as certain portions of the roll containing the layer of first color ink;

applying a layer of third color ink to other discrete areas of said roll containing neither the first nor second ink and as an overlapping layer to certain portions of the roll containing a layer of first color ink, to other portions containing a layer of second color ink and to still other portions containing a layer of first color ink and an overlapping layer of second color ink;

embossing a single length of sheet material by rotating the embossing and printing roll once in contact therewith;

printing a first color on the sheet material in the areas thereof contacted by the surface of the roll containing a layer of first color ink;

printing a second color on the sheet material in the areas thereof contacted by the surface of the roll containing a layer of second color ink;

printing a third color on the sheet material in the areas thereof contacted by the surface of the roll containing a layer of third color ink;

printing a fourth color on the sheet material in the areas thereof contacted by the surface of the roll containing overlapping layers of first and second color inks;

printing a fifth color on the sheet material in the areas thereof contacted by the surface of the roll containing overlapping layers of first and third color inks;

printing a sixth color on the sheet material in the areas thereof contacted by the surface of the roll containing overlapping layers of second and third color inks; and printing a seventh color on the sheet material in the areas thereof contacted by the surface of the roll containing overlapping layers of first, second and third color inks.

6. A process for multicolor valley printing and embossing of flooring material and the like comprising the steps of:

applying a first color ink to the surface of a first rotatable pattern roll;

transferring said first color ink from the first pattern roll to discrete surface areas of a single rotatable embossing and printing roll having a raised surface contour representing a pattern to be embossed and valley printed;

applying a second color ink to the surface of a second rotatable pattern roll;

transferring said second color ink from the second pattern roll to discrete surface areas of the embossing and printing roll not containing the first color ink and as well as discrete surface areas thereof containing the first color ink;

advancing a single sheet of flooring material once through a nip defined by the single embossing and printing roll and a rotatable backing roll; and embossing the flooring material in the nip under the pressure of the embossing and printing roll, and simultaneously valley printing said flooring material with a first color in the areas thereof contacted by the surface of the embossing and printing roll containing the first color ink, with a second color in the areas thereof contacted by the surface of the embossing, and printing roll containing the second color ink, and with a third color derived from blending the first and second color inks under the pressure of the embossing and printing roll in the areas of the flooring material contacted by the surface of the embossing and printing roll containing the overlapping layers of first and second color inks.

7. A process for multicolor valley printing and embossing of flooring material and the like comprising the steps of:

applying a plurality of different color inks, respectively to a corresponding plurality of rotatable pattern rolls;

transferring said different color inks from the pattern rolls to discrete surface areas of a once rotatable embossing and printing roll having a raised surface contour representing a pattern to be embossed and valley printed in a manner such that certain raised areas thereof receive a layer of ink from individual pattern rolls and other raised areas receive overlapping layers of different color inks from at least two different pattern rolls;

advancing a single sheet of flooring material once into contact with and under pressure of the embossing and printing roll; and embossing said sheet with the pattern on said embossing and printing roll, and simultaneously printing individual colors in the areas of the sheet contacted by the surface of the embossing and printing roll containing one layer of ink and printing additional blended colors derived from mixing overlapping layers of different color inks under the pressure of the embossing and printing roll in the areas of the sheet contacted by the surface of the embossing and printing roll containing the overlapping layers of different color inks.

8. A process for multicolor valley printing and embossing of sheet material and the like comprising the steps of:

applying a layer of first color ink to discrete surface areas of a single rotatable embossing and printing roll having a raised surface contour representing a pattern to be embossed and printed;

applying a layer of second color ink to other discrete surface areas of the embossing and printing roll and as an overlapping layer to predetermined portions of the surface area containing the layer of first color ink;

rotating said embossing and printing roll once in pressurized contact with a single length of sheet material;

embossing said sheet with the pattern on said embossing and printing roll;

printing the first color ink and the second color ink on the sheet in the area thereof contacted by the surface of the embossing and printing roll containing individual layers of such color inks; and printing an additional blended color derived from mixing the first and second color inks under the pressure of the embossing and printing roll in the areas of the sheet contacted by the surface of said roll containing said overlapping layers of first and second color ink.

9. A process for multicolor valley printing and embossing of sheet material and the like comprising the steps of:

applying a plurality of different color inks to the surface of a single rotatable embossing and printing roll in a manner such that certain discrete surface areas thereof receive a layer of single color ink and other discrete surface areas thereof receive overlapping layers of at least two different color inks;

embossing a single length of sheet material by rotating the embossing and printing roll single in contact therewith;

printing a single color on the sheet in the areas thereof contacted by the surface of the embossing and printing roll containing a layer of single color ink during the embossing operation and;

printing an additional blended color derived from blending overlapping layers of different color inks under the force of the embossing and printing roll in the areas of the sheet contacted by the surface of said roll containing the overlapping layers of different color inks during the embossing operation.

10. A process for multicolor valley printing and embossing of sheet material comprising the steps of:

applying a layer of first color ink to discrete surface areas of a single rotatable embossing and printing roll having a raised surface contour representing a pattern to be embossed and printed;

applying a layer of second color ink to other discrete areas of said roll not containing the first color ink and as well as certain portions of the roll containing the layer of first color ink;

applying a layer of third color ink to other discrete areas of said roll containing neither the first nor second ink and as an overlapping layer to certain portions of the roll containing a layer of first color ink, to other portions containing a layer of second color ink and to still other portions containing a layer of first color ink an overlapping layer of second color ink;

embossing a single length of sheet material by once rotating the embossing and printing roll in contact therewith.

printing a first color on the sheet material in the areas thereof contacted by the surface of the roll containing a layer of first color ink;

printing a second color on the sheet material in the areas thereof contacted by the surface of the roll containing a layer of second color ink;

printing a third color on the sheet material in the areas thereof contacted by the surface of the roll containing a layer of third color ink;

printing a fourth color on the sheet material in the areas thereof contacted by the surface of the roll containing overlapping layers of first and second color inks;

printing a fifth color on the sheet material in the areas thereof contacted by the surface of the roll containing overlapping layers of first and third color inks;

printing a sixth color on the sheet material in the areas thereof contacted by the surface of the roll containing overlapping layers of second and third color inks; and printing a seventh color on the sheet material in the areas thereof contacted by the surface of the roll containing overlapping layers of first, second and third color inks.

11. A process in accordance with claim 10, in which the fourth, fifth, sixth and seventh colors are derived by blending the overlapping layers of ink under pressure created by the embossing and printing roll.

12. The flooring material according to claim 10, in which the fourth, fifth, sixth and seventh colors are derived by blending the overlapping layers of ink under pressure created by the embossing and printing roll.

* * * * *